United States Patent [19]

Broadbent

[11] 4,418,680

[45] Dec. 6, 1983

[54] FIREPLACE DAMPER AND AIR FLOW CONTROL

[75] Inventor: Lynn C. Broadbent, Utah County, Utah

[73] Assignee: Merle Y. Broadbent, Alpine, Utah ; a part interest

[21] Appl. No.: 261,049

[22] Filed: May 6, 1981

[51] Int. Cl.[3] ..... F23L 3/00

[52] U.S. Cl. ..... 126/289; 126/285 A; 126/288

[58] Field of Search ..... 126/163 R, 164, 165, 126/120, 121, 288, 290, 123, 126, 131; 237/55, 51, 52, 79; 165/101, 103, 98, 99

[56] References Cited

U.S. PATENT DOCUMENTS

| | | | |
|---|---|---|---|
| 201,494 | 3/1878 | Briggs | 126/289 |
| 737,382 | 8/1903 | Frederick | 126/121 |
| 1,434,083 | 10/1922 | Brander | 126/121 |
| 1,468,964 | 9/1923 | Groth | 126/121 |
| 2,549,365 | 4/1951 | Borge | 126/288 |
| 3,322,417 | 5/1967 | Mitchell | 126/285 A |
| 3,943,995 | 3/1976 | Banko | 165/101 |

FOREIGN PATENT DOCUMENTS

| | | | |
|---|---|---|---|
| 684199 | 7/1930 | France | 165/98 |
| 601734 | 7/1978 | Switzerland | 126/121 |
| 266842 | 3/1927 | United Kingdom | 126/285 A |

*Primary Examiner*—James C. Yeung

*Attorney, Agent, or Firm*—Mallinckrodt & Mallinckrodt

[57] ABSTRACT

A damper and air flow control for use with fireplaces or stoves having a plurality of heat tubes extending through the exhaust passage for smoke and other products of combustion includes a plurality of slats secured in spaced side-by-side relation to one another. Each slat is adapted to be positioned above a heat tube when the damper is in open position so as to leave the spaces between the heat tubes substantially unobstructed. Each slat has a width greater than the space between the heat tube over which it is positioned when the damper is open and an adjacent heat tube so that the slats may be moved to a position where they substantially block the spaces between the heat tubes. Control apparatus is provided to move the slats between open, closed, or partially closed positions.

6 Claims, 5 Drawing Figures

FIREPLACE DAMPER AND AIR FLOW CONTROL

BACKGROUND OF THE INVENTION

1. Field

The invention is in the field of dampers and air flow controls for fireplaces and stoves, particularly enclosed fireplaces and stoves that have a plurality of heat tubes extending through the entrance to the chimney or flue, such heat tubes generally being used to heat circulating air, and wherein such fireplace or stove leaves little or no access to operate a conventional damper in a chimney or flue.

2. State of the Art

Most fireplaces have chimney dampers located in the chimney above the fireplace with linkage extending down into the open portion of the fireplace where it can be easily reached and manipulated by the fireplace user.

With the advent of enclosed fireplaces that are used for heating as well as enjoyment and enclosed fireplace inserts or stove inserts that fit into existing fireplaces, operation of existing chimney dampers becomes very difficult. Most of these fireplaces or stove units have heat tubes passing through the entrance to the chimney which are used to heat air blown therethrough. Many of these enclosed fireplaces or stoves do not utilize a damper in the usual sense but stop air flow up the chimney by closing off all air entrances into the fireplace. This is effective in some instances but many times it is desireable to close the chimney above the fireplace or to be able to partially close such chimney to control air flow through it.

In some instances, linkage is set up to operate the existing dampers or cumbersome additional dampers are used as part of the enclosed fireplaces. However, these remains a need for a simple and effective damper and air flow control for such fireplaces and stoves.

SUMMARY OF THE INVENTION

According to the invention, a simple damper and air flow control for fireplaces or stoves having a plurality of heat tubes extending through the passage in such fireplace or stove where the smoke and other products of combustion pass to the chimney, comprises a plurality of slats secured is spaced, side-by-side relation to one another with each slat adapted to be positioned above a heat tube when the damper is in open position. With each slat positioned above a heat tube, the spaces between the heat tubes are left substantially unobstructed.

The width of each individual slat is greater than the distance between the heat tube over which that slat is positioned and the adjacent heat tube so that by moving the slats, they progressively block the spaces between the heat tubes and substantially completely block the spaces between the tubes when in closed position.

Various means may be used to move the slats, a preferred means being a shaft extending from the front exterior of the fireplace directly back to the passage where the damper is located. The shaft is mounted for rotation so that an arm on the end of the shaft may be positioned to engage a clevis associated with the sets of slats. By rotating the shaft, the arm causes the slats to move across the heat tubes.

The damper may be designed to fill all openings to the chimney or to leave one or two small openings depending upon the requirement of the particular fireplace.

THE DRAWINGS

In the accompany drawings, which represent the best mode presently contemplated for carrying out the invention:

FIG. 1, is a perspective view of a fireplace insert designed to fit into a conventional fireplace opening and having the damper device of the invention installed therein;

FIG. 2, a fragmentary vertical section of the fireplace taken along the line 2—2 of FIG. 1 and showing the passage to the chimney;

FIG. 3, a fragmentary top plan view of the fireplace taken along the line 3—3 of FIG. 1 and showing the passage to the chimney;

FIG. 4, a view similar to FIG. 2 but showing the damper in closed position; and FIG. 5, a view similar to FIG. 2 but showing a slightly different embodiment.

DETAILED DESCRIPTION OF THE ILLUSTRATED EMBODIMENT

Figure 1:
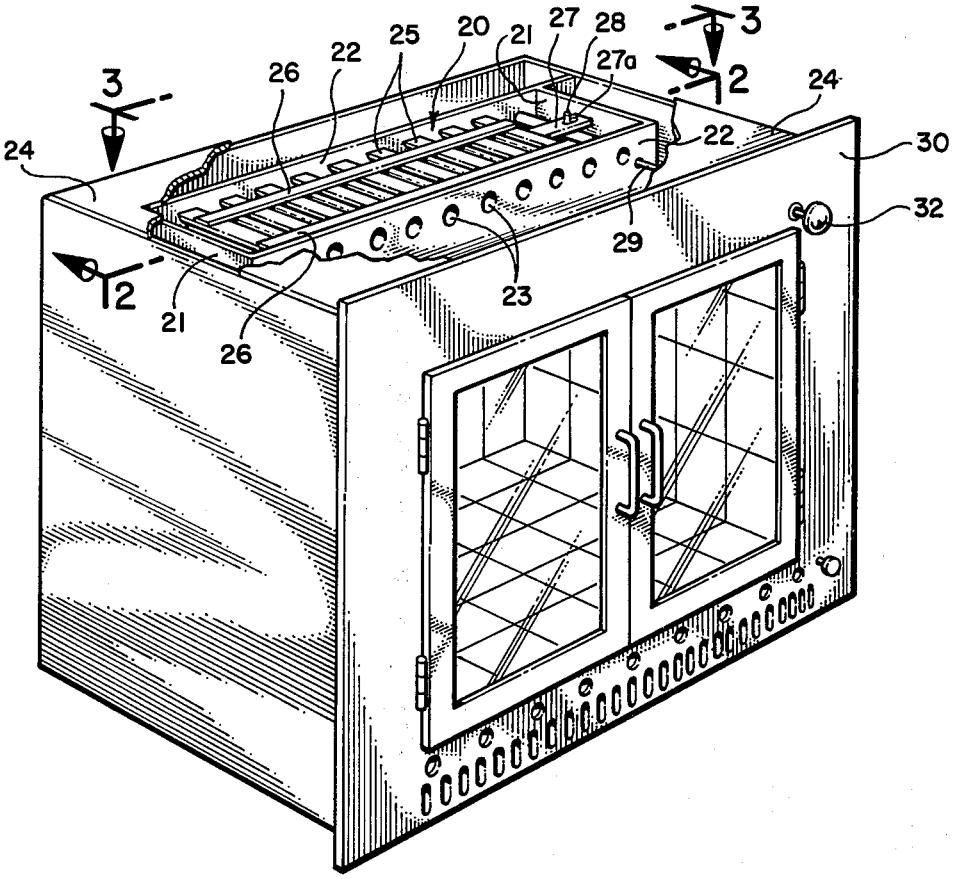

The invention will be described in detail with reference to a fireplace insert as shown in FIG. 1. Such insert is designed to fit into a normal fireplace opening but surrounds the firebox with a heat collecting jacket designed to heat air which is circulated through passages between the walls of the firebox and the outside walls of the insert.

The insert has a passage 20 leading from the firebox which is adapted to connect with the usual chimney to provide a passage for the escape of smoke and other products of combustion from any fire in the fire box. The passage is formed by two pairs of opposite sides 21 and 22. The passage has a series of heat tubes 23 passing therethrough which are heated by the smoke and exhaust gases and transfer such heat to air which is forced through the tubes. A top plate 24 covers all but opening 20 to the chimney.

Figure 2:
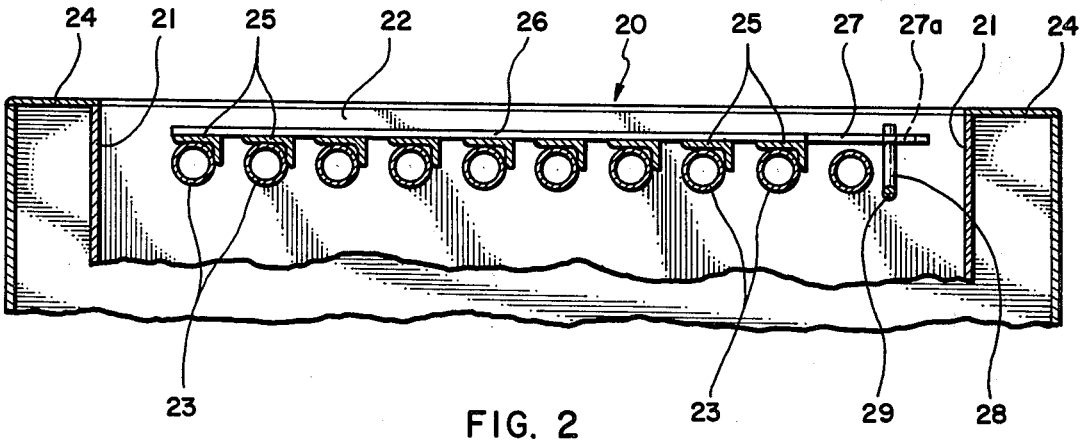
Figure 3:
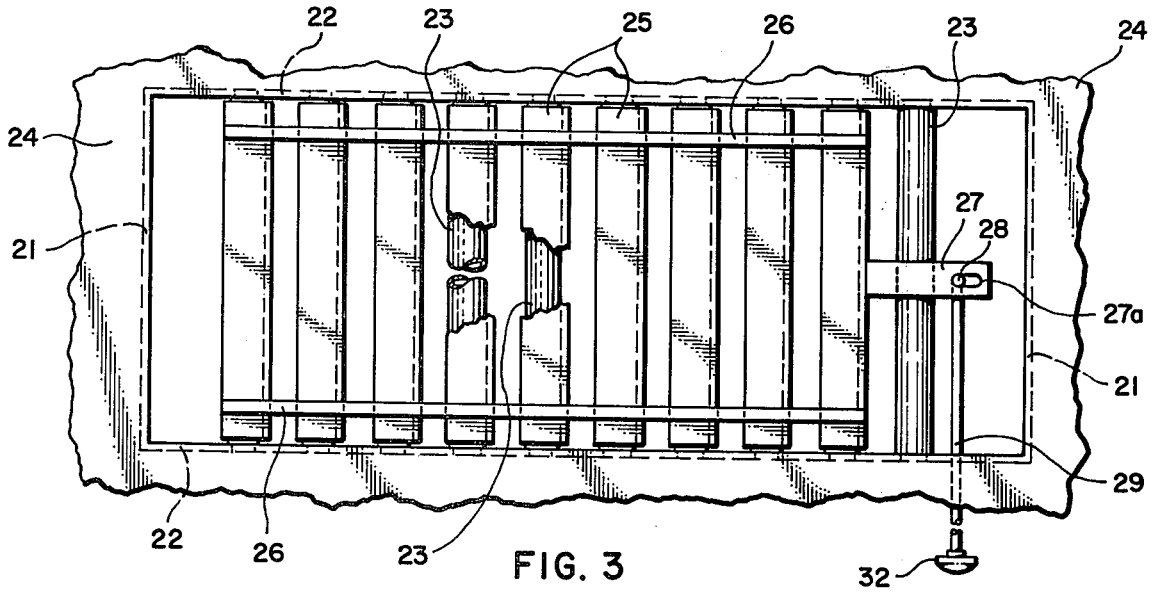

Referring to FIGS. 2 and 3, the damper and air flow control of the invention is made up of a series of slats 25 which may conveniently be formed of angle irons as shown. The width of the slats, the top portion of the angle iron, is at least equal to substantially the spacing between the heat tubes. Generally in such fireplaces the heat tubes will be equally spaced in the passage to the chimney with a somewhat larger space between the end tubes and the side walls 21.

In open position, the slats are arranged so that each slat 25 is over a heat tube 23 as shown in FIG. 2. The slats are secured together by bars 26 which may be welded or otherwise attached to the slats. The downwardly extending vertical leg of the slat or angle iron is preferably long enough to contact the side of the heat tube at the point closest the adjacent heat tube.

For purposes of illustration, one fireplace with which the damper of the invention is used has a passage twleve inches wide and thirty-two inches long. Within such passage are ten equally spaced heat tubes of one and one-half inch outside diameter. The spacing between the end tubes and the end walls is slightly greater than spacing between the tubes. The angle irons used as slats are one and one-half inch by seven-eighths inch, the shorter side being the downwardly extending vertical side.

A bar 27 extends from one end slat and has a hole 27*a* therein which forms a clevis to receive an arm 28 extending from a shaft 29. Shaft 29 is journaled for rotation in front wall 22 of the passage and in front wall 30, FIG. 1, of the fireplace insert. A knob 32 secured to the end of shaft 29, facilitates its rotation. Arm 28 may be formed by bending the end of shaft 29, or may be a separate piece secured, such as by welding, to the end of shaft 29.

Figure 4:
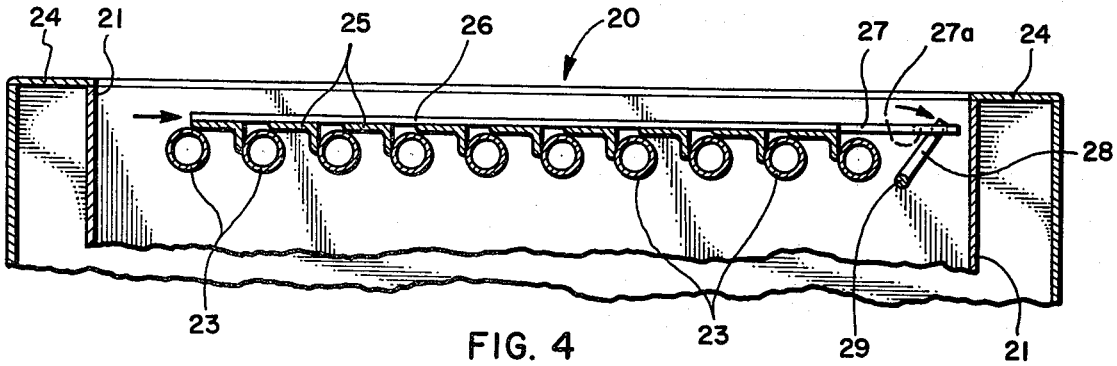

With the damper device in position as shown in FIGS. 2 and 3, as shaft 29 is rotated clockwise, arm 28 moves to the right causing the slats to move to the right. As the slats move they progressively block more and more of the spaces between the heat tubes until the position shown in FIG. 4 is reached where the slats completely obstruct the spaces between the heat tubes. In this position the damper device is closed. By rotating the shaft 29 counterclockwise, the device is moved back to its open position as shown in FIG. 2.

The downwardly extending vertical leg of the slat serves as a stop in either direction for travel of the slats between open and closed position. While such vertical leg is not necessary and various other stop means could be used, such as making the slat connecting bars 26 of length to abut against opposite walls 21 of the passage when in open or closed position respectively, the use of angle irons for the slats which provide the vertical legs has been found easy and satisfactory. When in closed position, the vertical legs also help to close the space between the tubes as seen in FIG. 4.

With the embodiment shown in FIGS. 2–4 in closed position, only the spaces between the heat tubes are closed. The spaces between the end heat tubes and the end walls of the passage 21 remain open. This is satisfactory in many instances, and in fact, in instance where the device is used principally as an air flow control, is preferred. Thus, with a fireplace as shown, when it is desired to burn the fuel in the firebox slowly, the flow of air through the firebox may be restricted to limit the amount of air available for oxidation of the fuel. If this is done merely by closing off the flow of air into the firebox as is normally done with enclosed fireplaces and stoves, it is found that the hot gases resulting from the reduced combustion tend to concentrate in only one small position of the passage to the chimney, usually the center. This means that heat from those gases is transferred to only a few of the heat tubes. When the device of the invention is used, either alone to control the amount of air flow through the firebox, or in conjunction with control of air inlets to the firebox, the hot gases of combustion are directed from the center area of the passage to the opposite outside walls 21 of the passage and in so moving, heat most or all of the heat tubes. The efficiency of heating with a slow burning fire is significantly increased with the device of the invention closed. When using greater, but not unrestricted burning rates, the damper device may be partially closed to spread out the hot gases.

Figure 5:
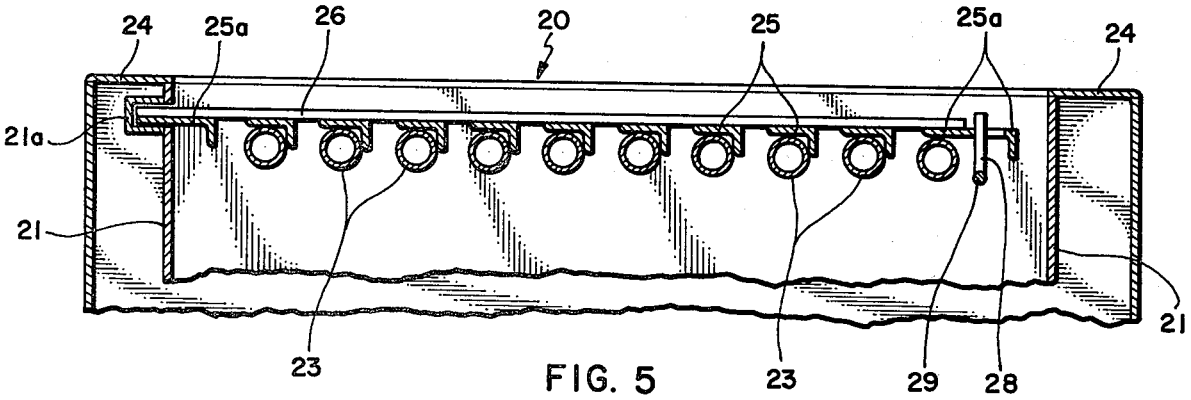

If it is desired to completely close off the exhaust passage with the device, an additional slat **25*a* may be added to each end of the device as shown in FIG. 5. To add one of the end slats it is necessary to add a small extension 21*a* to one of the side walls 21 so that the end slat is in position out of the passage when the device is open. Space for this extension is generally available in this type of fireplace. Since the end spaces are usually a little larger than the spaces between the heat tubes, the end slats 25*a*** should be slightly wider than the itermediate slats if complete closure is desired. Most building codes require that a damper not completely seal a chimney so that some airflow be allowed. Thus, it will usually be necessary to provide for a small open space when the damper is closed.

Since a slightly wider slat is necessary with the full damper shown in FIG. 5, the control shaft 29 may be located adjacent the outside heat tube, inside the vertical leg of the slat, and the clevis formed in the upper surface of the slat. Operation is identical to that already described.

It will be obvious that various types of linkages and controls may be used to slide the slats between open and closed positions. These may include push-pull mechanisms and swinging arms. The shaft and arm illustrated is simple, easy to use, and has been found to work well. It is preferred that the clevis be located near the center of the length of the slats to reduce any tendency for the slat assembly to want to rotate as it slides in the passage, and as a result, tend to bind against walls 22. However, such centering of the clevis, while providing smoother operation, is not necessary.

In fireplaces where the heat tubes run lengthwise in the exhaust passage rather than across as illustrated, the slats would also run lengthwise and a simple pushpull lever could be attached thereto for operation.

In some instances, the width of the slats will need to be somewhat larger than the widths of the heat tubes and in such instances, the slats may extend over the heat tubes to some extent on either side slightly blocking the spaces between the heat tubes. This is no problem as long as the spaces remain open enough to allow the exhaust gases to escape satisfactorily. In such instances, the spaces are substantially unobstructed.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A fireplace damper and airflow control for use with fireplaces or stoves having a plurality of heat tubes extending through the exhaust passage for smoke and other products of combustion, comprising a plurality of slats secured in spaced, side-by-side relation to one another, each slat being adapted to be positioned above a heat tube when the damper is in open position so as to leave the spaces between the heat tubes substantially unobstructed, and each slat having a width greater than the space between the heat tube over which it is positioned when the damper is open and an immediately adjacent heat tube; and means for moving the slats in unison from position over the heat tubes to position where the slats block or partially block the spaces between the heat tubes, the slats being arranged so that, when in closed position, the slats substantially block the spaces between the heat tubes but the spaces between the outside heat tubes and the opposite edges of the exhaust passage remain at least partially open.

2. A fireplace damper and air flow control according to claim 1, wherein the slats are made of angle irons.

3. A fireplace damper and air flow control according to claim 1, wherein the means for moving the slats includes a shaft journaled for rotation, an arm on one end of the shaft, and a clevis associated with the slats in which the arm is received so that rotation of the shaft causes movement of the slats between open and closed position.

4. A fireplace damper and air flow control according to claim 3, wherein the slats are made of angle irons.

5. A fireplace damper and air flow control according to claim 4, wherein one leg of the angle iron acts as a stop for the slats when in fully open or fully closed position.

6. A fireplace damper and air flow control according to claim 3, wherein the clevis is secured to an end slat and is located substantially centrally of its length.

* * * * *